US010810976B2

(12) United States Patent
Augustine

(10) Patent No.: US 10,810,976 B2
(45) Date of Patent: Oct. 20, 2020

(54) GUITAR STRING LOCKING DEVICE AND METHODS OF USE

(71) Applicant: Leigh Augustine, Greenwood Village, CO (US)

(72) Inventor: Leigh Augustine, Greenwood Village, CO (US)

( * ) Notice: Subject to any disclaimer, the term of this patent is extended or adjusted under 35 U.S.C. 154(b) by 0 days.

(21) Appl. No.: 16/668,357

(22) Filed: Oct. 30, 2019

(65) Prior Publication Data

US 2020/0152161 A1 May 14, 2020

Related U.S. Application Data

(60) Provisional application No. 62/757,263, filed on Nov. 8, 2018.

(51) Int. Cl.
*G10D 3/12* (2020.01)
*G10D 3/153* (2020.01)

(52) U.S. Cl.
CPC ..... *G10D 3/12* (2013.01); *G10D 3/153* (2020.02)

(58) Field of Classification Search
CPC ..... G10D 3/12; G10D 3/153
See application file for complete search history.

(56) References Cited

U.S. PATENT DOCUMENTS 4,171,661 A 10/1979 Rose
4,579,033 A 4/1986 Edwards
6,835,880 B1 * 12/2004 Silva ..... G10D 3/053 84/318
7,297,851 B2 11/2007 Caldwell
2001/0027711 A1 * 10/2001 Campling ..... G10D 3/053 84/318

OTHER PUBLICATIONS

Fender System 3 bridge, https://reverb.com/item/4888803-fender-contemporary-rare-rare-rare-fender-system-3-1985-black, post entitled "Fender Contemporary RARE, RARE, RARE, Fender System 3 1985 Black" Earliest date of publication 2017, accessed from reverb.com on Jun. 4, 2020.
Yamaha RGX620DZ, https://reverb.com/item/6766176-yamaha-rgx620dz-grey-green-awesome-build-quality, post entitled "Yamaha RGX620DZ GREY/GREEN. Awesome Build quality!" Earliest date of publication 2017, accessed from reverb.com on Jun. 4, 2020.

* cited by examiner

*Primary Examiner* — Kimberly R Lockett

(57) ABSTRACT

Disclosed is a locking tool for guitar strings and associated use methods. One embodiment provides a string locking device having a base affixed to a neck of the guitar. The base includes a compression bed bordered by proximal and distal sets of string channels, where the strings enter through the proximal channels, extend across the compression bed, and exit through the distal channels. The locking device also includes a press that is rotatively coupled to the base and a fastening mechanism configured to secure the press in a closed position relative to the base. The press may pivot between an open position in which the press is offset from the base and a closed position in which the press is secured against the compression bed such that the strings are secured between the press and the compression bed, preventing the strings from detuning during play. Other embodiments are disclosed.

9 Claims, 10 Drawing Sheets

GUITAR STRING LOCKING DEVICE AND METHODS OF USE

CROSS-REFERENCE TO RELATED APPLICATIONS

This application claims priority to U.S. Provisional Patent Application Ser. No. 62/757,263, filed on Nov. 8, 2018, the entire content of which is incorporated herein by reference.

BACKGROUND

The present disclosure involves locking devices for guitar strings. FIG. 1 illustrates a front view of an exemplary Stratocaster electric guitar. The guitar includes a body having a neck extending proximally-to-distally therefrom. A number of strings (e.g., six strings) extend from a bridge on the body to tuning pegs at a distal end of the neck. The strings are positioned over a finger board, or a fretboard, that includes a number of frets extending therefrom. When not played, all strings are suspended by a "nut" on one side (near the tuning keys) and a "bridge" (the opposite end of the guitar).

A variety of systems have been developed to add vibrato to the sound of the Stratocaster and similar guitars by changing the tension of the strings, typically at the bridge of the guitar using a controlling lever, often referred to as a whammy bar or vibrato arm/bar. The lever enables the player to quickly vary the tension of the stings and, accordingly, the length of the strings temporarily, changing the pitch to create a vibrato or pitch-bend effect. The vibrato systems (sometimes referred to as tremolo systems) found on the Stratocaster and similar guitars all present a similar problem: The strings "detune" or go out of tune (i.e., range sharp or flat) when the controlling lever like the whammy bar or vibrato arm is depressed and released because the strings slip over the nut. Thus, guitars equipped with any vibrato system are generally harder to keep in tune than fixed tailpiece guitars.

Several products currently on the market are designed to correct the inherent design flaws of vibrato systems used on guitars. These products are called, generally, "locking nuts." Each of these products presents its own challenges. For example, locking nuts are known in the art to assist in maintaining the tuning of the strings by "locking" the strings at the nut (and relative to the main tuning pegs), which prevents inadvertent slippage of the strings at the nut during play. One example of a typical locking nut known as the Floyd Rose nut is shown in FIGS. 2A-2C. Known locking nuts are generally permanently mounted to the distal end of the guitar neck beneath the strings, as shown in FIG. 2B, while a number of clamping blocks are tightened down onto the locking nut from above, thereby clamping the string(s) between the nut and the clamping block(s) to achieve the string-locking benefits described above. Tightening the clamping blocks down onto the nut generally requires a dedicated procedure and the use of locking hardware, such as one or more locking screws (e.g., hex screws) and associated tooling such as an appropriately-sized driver (e.g., hex wrench), as shown in FIG. 2C. Moreover, to change strings, the clamping blocks and the locking screws must be removed entirely from the guitar.

Another existing string locking option involves a clamp commonly known as a capo (e.g., a Shubb Capo), shown in FIGS. 3A-3B. The capo involves securing a clamp about the neck of the guitar such that a lower arm is positioned behind the neck, and an upper arm is positioned above the finger board and the strings. The lower and upper arms are manually tightened to compress the strings against the neck and lock the strings in place. Most capos also require tightening hardware such as a tension screw for adjusting the clamp's tightness. A capo is not permanently affixed to the fretboard; it must be removed entirely when not in use. It is also noteworthy that a capo is generally used on guitars to change the pitch of "open" or "unfretted" strings, and not used to "lock" strings down for purposes of using a whammy or tremolo bar. Capos are mentioned here merely for illustration purposes.

Other existing devices for locking guitar strings on the neck exhibit similar challenges in functionality, ease of use, and lack of simplicity.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

One embodiment provides a string locking device for a guitar having a body, a neck extending proximally-to-distally from the body toward a number of tuning pegs, a fretboard disposed upon the neck, and a number of strings extending above the fretboard from the body to the tuning pegs, the guitar having a first side adjacent to a thinnest string of the set of the strings and a second side adjacent to a thickest string of the set of the strings, the string locking device comprising: (1) a base affixed to the neck adjacent to a distal end of the fretboard, the base extending from a first end positioned at the first side of the guitar to a second end positioned at the second side of the guitar, the base including a compression bed bordered by a set of proximal string channels and a set of distal string channels, wherein each of the strings extends through a select one of the proximal string channels, across the compression bed, through an aligned one of the distal string channels, and to an aligned one of the tuning pegs; (2) a press disposed above the base, the press extending from a first end positioned at the first side of the guitar to a second end positioned at the second side of the guitar; (3) a rotative coupling configured to pivotally connect the press to the base, the rotative coupling positioned toward the first end of the base; and (4) a manual fastening mechanism configured to secure the press in a closed position relative to the base, the fastening mechanism positioned toward the second end of the base, wherein when the press is in the closed position, the number of the strings are secured between the compression bed and the press.

Other embodiments are also disclosed.

Additional objects, advantages and novel features of the technology will be set forth in part in the description which follows, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

Various embodiments of the systems and methods described herein relate to a guitar string locking device and associated methods of use for locking guitar strings in place relative to the neck and the tuning pegs to prevent the strings from detuning when a vibrato system located at the bridge of the guitar is employed during play (e.g., a vibrato arm is depressed and released during play).

As discussed above in the Background section, existing devices for locking the strings require the use of locking hardware such as hex screws and associated tooling in order to cinch the locking devices about the strings to a necessary and/or desired tightness. Such hardware and tooling requirements are cumbersome, and they limit the player's access to the main tuning pegs located at the distal end of the guitar neck. As a result, they can be impractical for quick string changes or re-turning and for users desiring to toggle between an employed locking device and playing without a locking device during the same session of play. In addition, many existing devices apply an equal amount of cinching or locking force across all of the strings, which can result in either an insufficient tightening force placed upon the thickest string(s) or, conversely, a snapping or severing of the thinnest string(s) in response to a tightening force that is required to lock the thickest string(s). Thus, there is a need for a string locking device that achieves a varied locking force across a range of guitar strings, that may be quickly moved into and out of a closed or "locked" position without the use of locking hardware or external tools, and that may be moved into the open position without requiring all of the device or components of the device to be removed from the guitar to be stored at a separate location.

Embodiments of a string locking device disclosed herein may be mounted upon a distal end of the guitar neck and thereafter moved quickly, without the use of locking hardware or tooling, between an open position in which the strings remain free and a closed position in which the strings are locked or secured at a variable pressure that is appropriate across the thickest to the thinnest strings. Once installed, the device may be moved to a closed position in which the strings are locked relative to the guitar neck and tuning pegs. If desired, the device may be selectively placed in an open position in which the strings are not locked during play, during re-turning, and so on.

Figure 1:
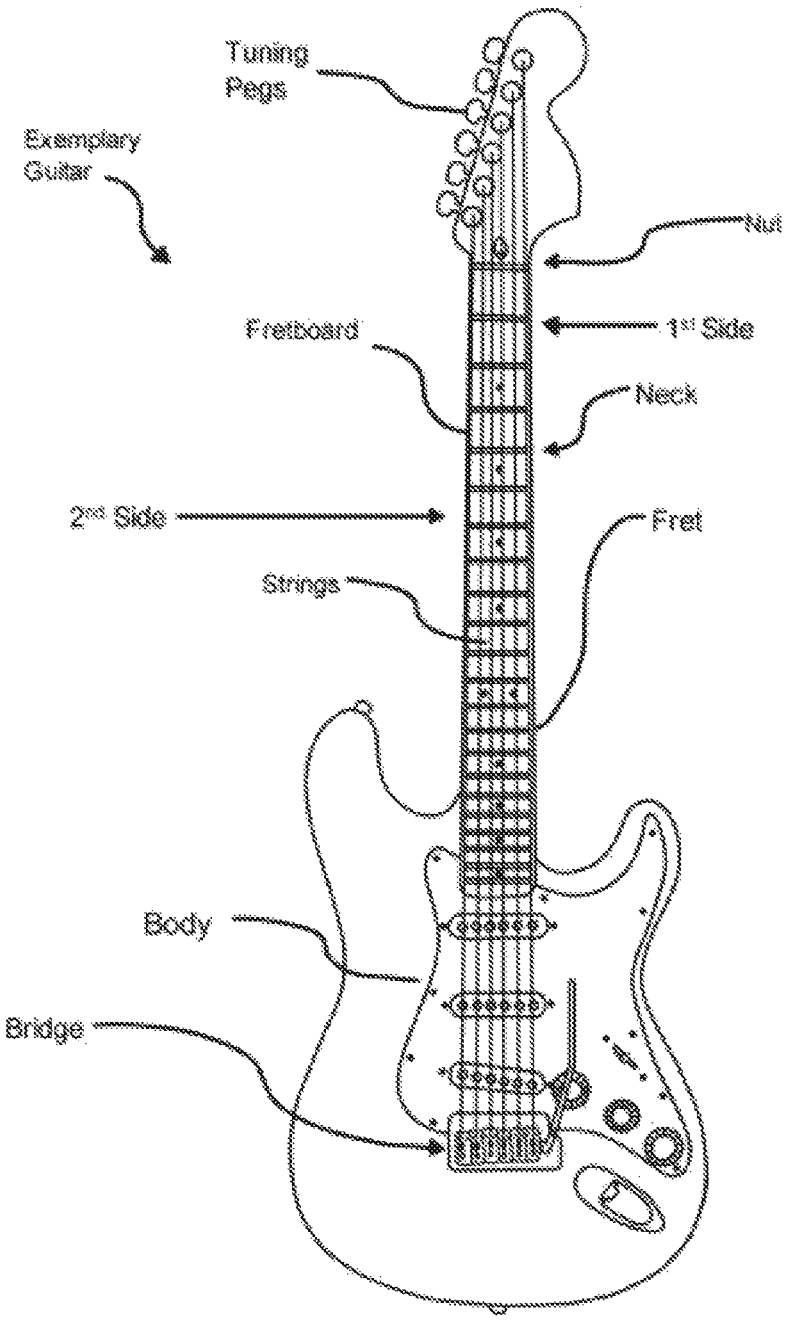
FIG. 1 (PRIOR ART)
FIG. 1 illustrates a front view of an exemplary guitar.
Figure 2A:
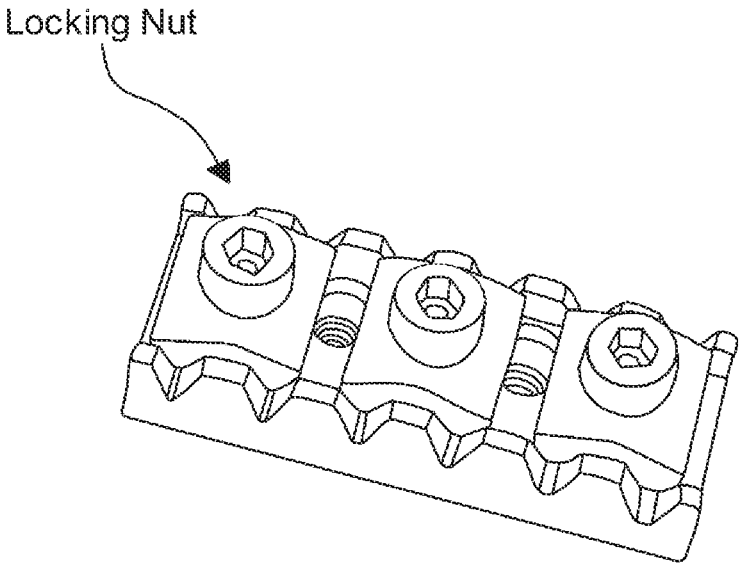
FIG. 2A (PRIOR ART)
FIG. 2A illustrates one example of a string locking nut.
Figure 2B:
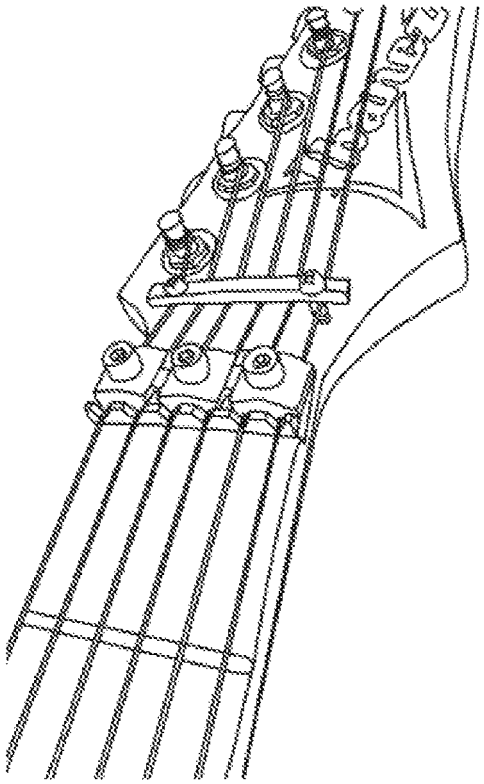
FIG. 2B (PRIOR ART)
FIGS. 2B-2C illustrate the string locking nut of FIG. 2A, as installed and partially installed on a guitar similar to FIG. 1, respectively.
Figure 2C:
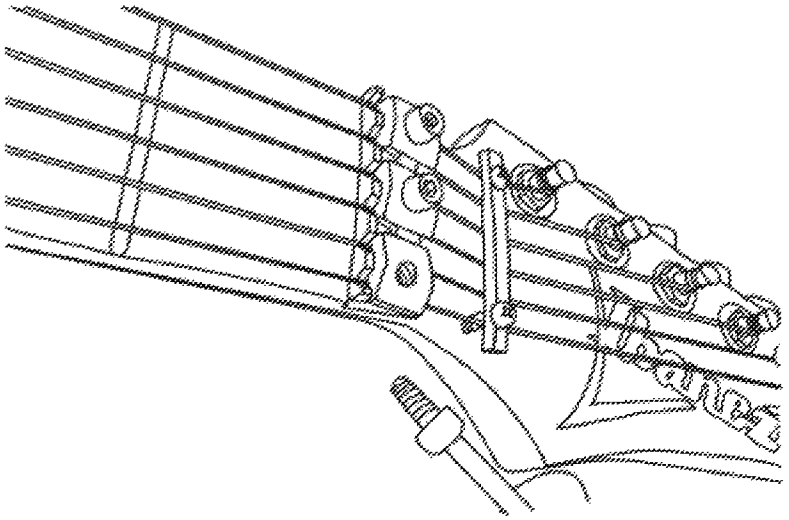
FIG. 2C (PRIOR ART)
Figure 3A:
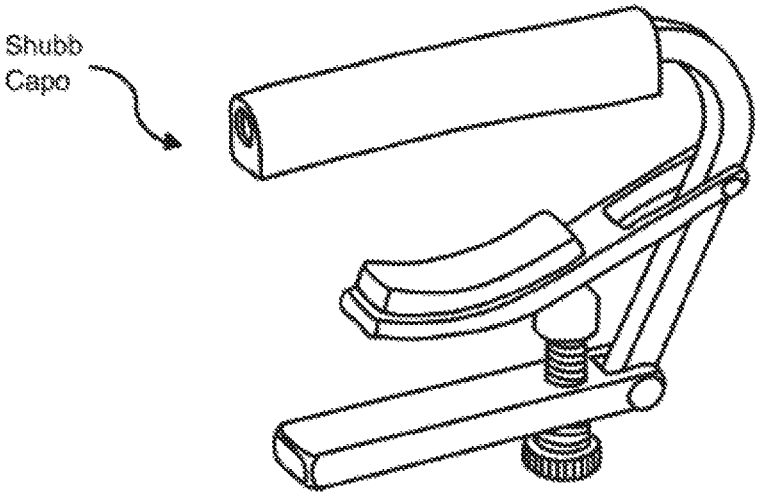
FIG. 3A (PRIOR ART)
FIG. 3A illustrates an example of a prior art capo clamp for locking guitar strings.
Figure 3B:
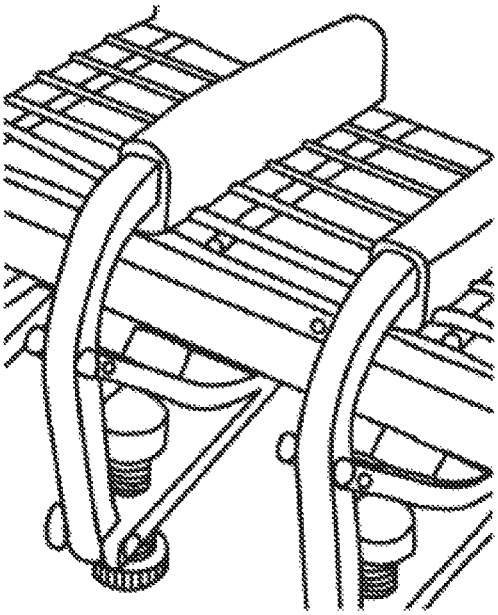
FIG. 3B (PRIOR ART)
FIG. 3B illustrates the prior art capo clamp of FIG. 3A as installed on a guitar similar to FIG. 1.
Figure 4:
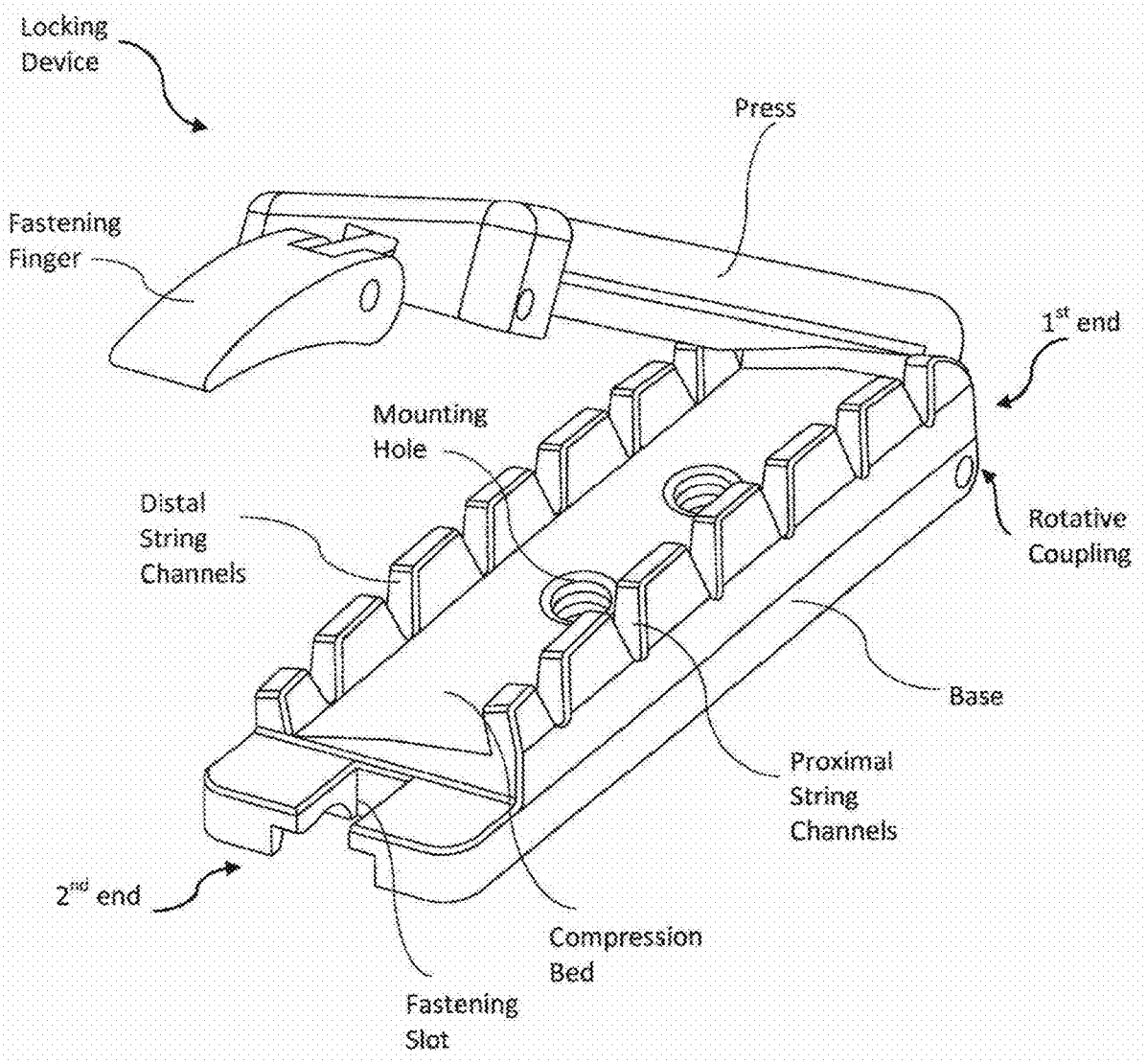
FIG. 4 illustrates a perspective view of one embodiment of a string locking device of the present invention in an open position.
Figure 5A:
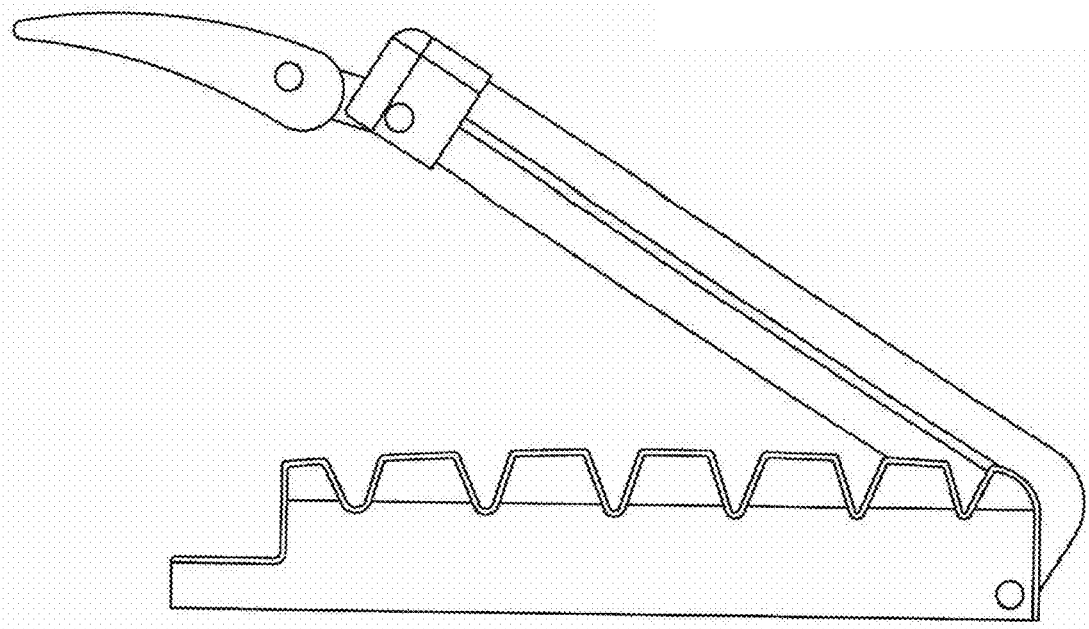
FIG. 5A illustrates an embodiment of a side view of the string locking device of FIG. 4 in an open position.
Figure 5B:
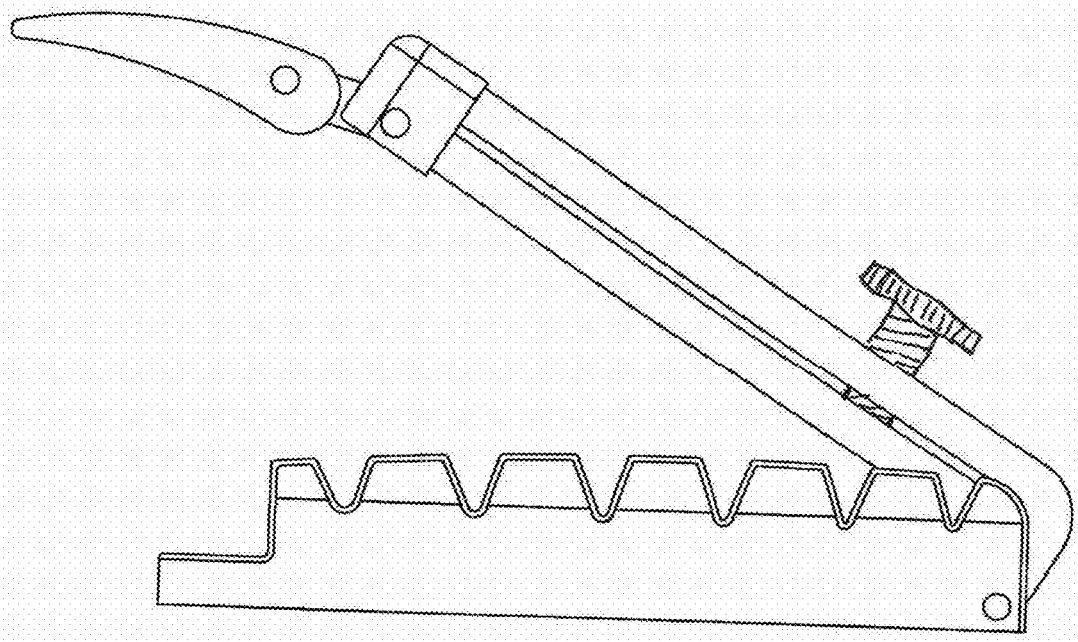
FIG. 5B illustrates another embodiment of a side view of the string locking device of FIG. 4 in an open position.
Figure 6:
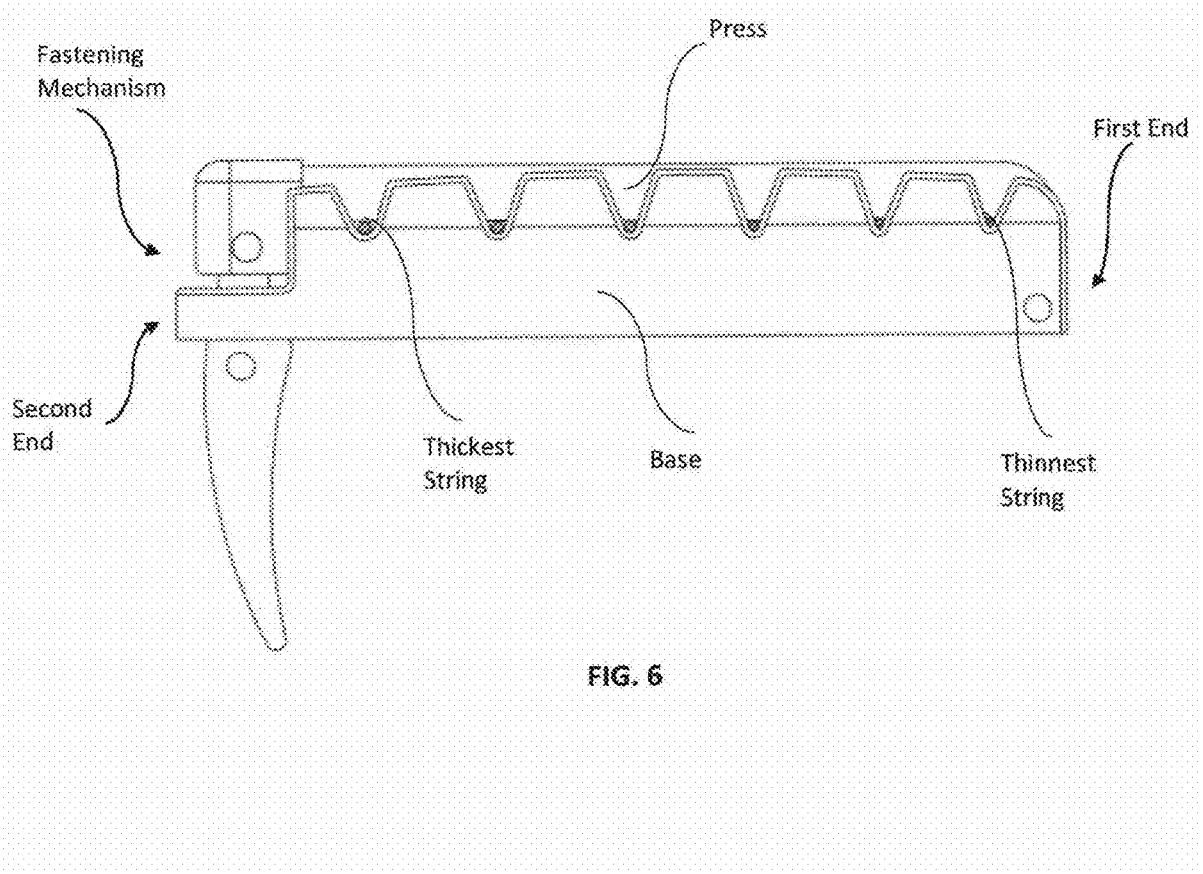
FIG. 6 illustrates a side view of the string locking device of FIG. 4 in a closed position.

FIGS. 4-6 illustrate perspective and side views of one embodiment of a guitar string locking device for securing guitar strings in place to prevent them from detuning. In this embodiment, the string locking device may comprise a fixed base 100, a rotative coupling 101 (e.g., a hinge or hinge pin) located at a first end 102 of the fixed base 100, a hinged press 103 pivotally coupled to the fixed base 100 via the rotative coupling 101, and a fastening mechanism 104 located at a second end 105 of the fixed base 100 and configured to secure the hinged press 103 in a closed position relative to the fixed base 100.

Figure 7:
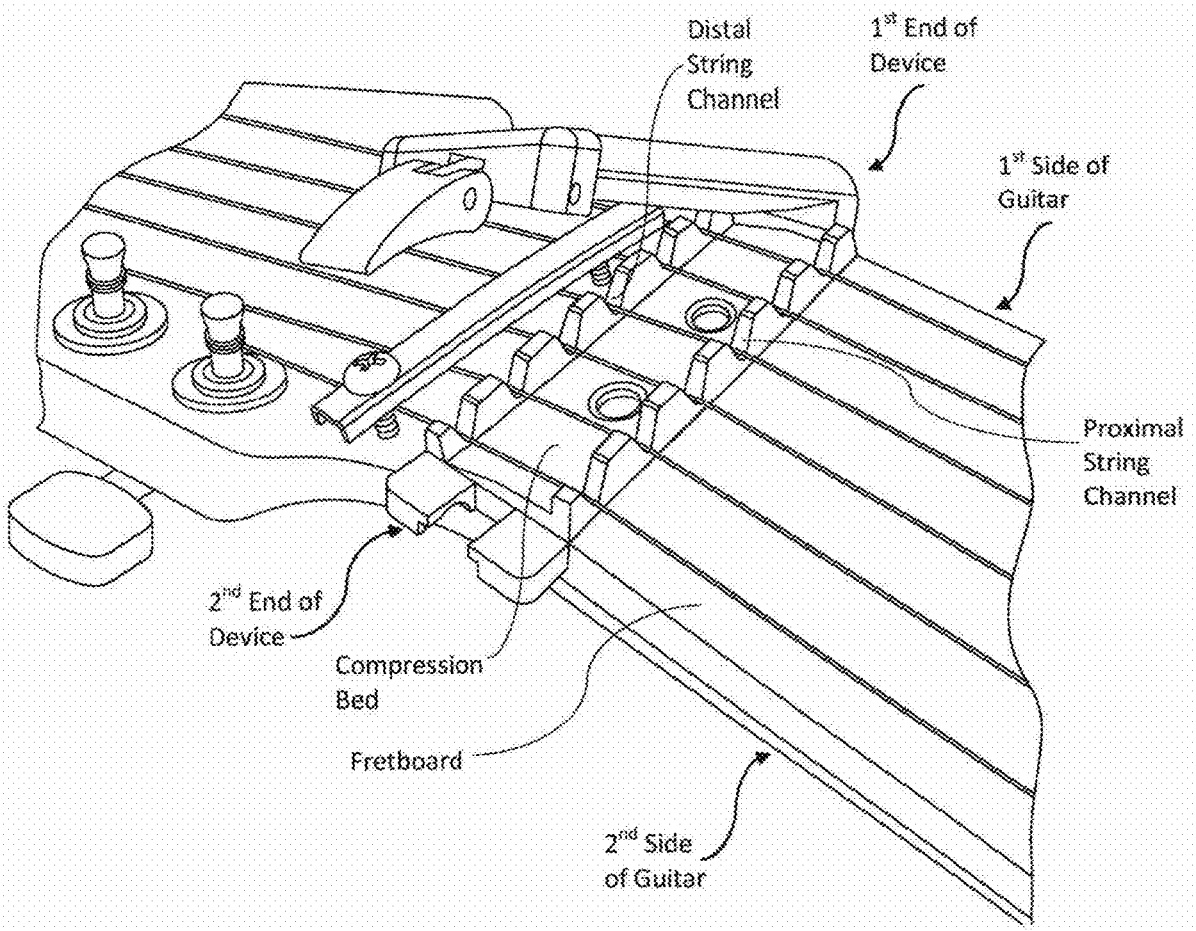
FIG. 7 illustrates a perspective view of the string locking device of FIG. 4, as installed on the guitar of FIG. 1.
Figure 8:
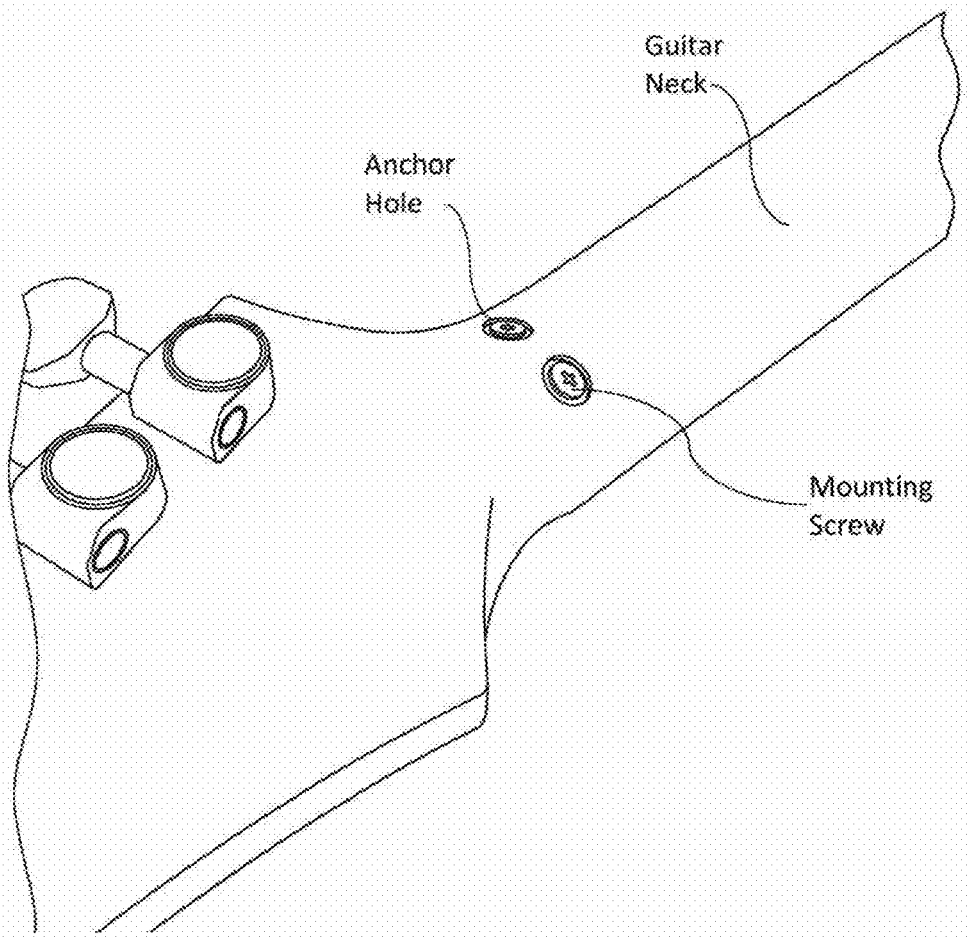
FIG. 8 illustrates a rear view of the guitar of FIG. 1, as modified for installation of the string locking device of FIG. 4, as shown in FIG. 7.

The fixed base 100 may include first 106 and second mount holes 107 configured to affix the base 100 to a distal end of the guitar neck, adjacent to the fingerboard. Specifically, the first 106 and second 107 mount holes may be positioned to align with corresponding anchor holes 106, 107 drilled in the neck of the guitar, as shown in FIGS. 7-8. Mounting screws 108 may extend through the first 106 and second mount holes 107 of the fixed base 100 to anchor within the anchor holes 106, 107 drilled in the guitar neck, thereby permanently or semi-permanently affixing the base 100 to the neck of the guitar such that the base 100 lies between the fingerboard and the strings, as shown in FIG. 7. In one embodiment, the first end 102 of the base 100, and thus the rotative coupling 101, may be aligned with the first side of the guitar neck such that the rotative coupling 101 faces downward when the guitar is held by the player. In this configuration, the rotative coupling 101, which aligns with the edge of the neck, does not interfere with the player's hand during play, as shown in FIG. 7.

The fixed base 100 may form a generally c-shaped cross-section including a compression bed 108 bordered on each side by sets of proximal string channels 109 and distal string channels 110. When the base 100 is affixed in place upon the guitar neck, each of the guitar strings stretches proximally-to-distally through an appropriate one of the proximal string channels 109, 110, across the compression bed 108, through an appropriate one of the distal string channels 110, and to an aligned tuning peg, as shown in FIG. 7. The borders of the proximal 109 and distal string channels 110 of the base 100 may be chamfered or rounded at the first end 102 to further ensure non-interference with the player's hand during play.

The rotative coupling 101 may be any appropriate coupling that pivotally couples the press 103 to the first end 102 of the base 100. Embodiments of the rotative coupling 101 may include a hinge, a pivot pin, or another rotative mechanism.

In this embodiment, the press 103 may be formed of a single piece that extends across the compression bed 108 from the rotative coupling 101 to the fastening mechanism 104. The press 103 rotates about the rotative coupling 101 between an open position, shown in FIGS. 4-5A and 5B, and a closed position, shown in FIG. 6. When rotated into the open position, the press 103 is released from the strings to allow the player quick access to the change or re-tune the strings. The press 103 is not and need not be removed when in the open position, allowing the player to simply release the fastening mechanism 104 with a single hand before changing or re-tuning the strings.

When rotated into the closed position and locked via the fastening mechanism 104, the press 103 applies pressure to the springs from above (i.e., orthogonal to the fretboard), thus pressing the strings between the press 103 and the compression bed 108, across a width of the compression bed 108 between proximal 109 and the distal string channels 100.

In this embodiment, and as shown in FIGS. 4-7, the fastening mechanism 104 may include a finger that protrudes distally from the press 103 and is configured to engage with/catch against a mating slot 111 that protrudes outward from the second end 105 of the base 100. In other embodiments, the fastening mechanism 104 may be a swing catch, a snap-lock, a drawbolt-and-buckle lock, a barrel-bolt lock, a belt-and-band lock, a wedge/taper lock, a quick-release pin, a rack-and-pinion lock, a cam clamp (e.g., a bike tire skewer), or any other appropriate fastening mechanism 104.

The press 103 and the locking mechanism 104 may be geometrically configured such that the press 103 applies a securing pressure to the strings when in the closed position. The securing pressure may be a pressure, or distributed force, that is sufficient to secure or lock the strings in place, but that is not so high as to sever any of the strings. Additionally, in one embodiment, the press 103 may have a variable thickness that gradually increases from the first end 102 to the second end 105 of the press 103, such that a lower pressure is applied to the thinner strings (i.e., beginning with the "high E"—thinnest string—on the first side 102 of the press 103) at the first end 102 and additional pressure is gradually applied to the thicker strings (ending with the "low E"—thickest string) at the second end 105. In this configuration, a significant pressure may be applied to the thickest strings, ensuring that they are adequately locked, without risking severing the thinner strings as a result of "cranking down" on the thicker strings. Alternatively, the variable thickness may decrease from the first end 102 toward the second end 105 of the press 103. The ascending or descending thickness may be a function of the string material, tension, configuration, and/or other appropriate factors.

In another embodiment, the base 100, the press 103, and/or a combination of the two components may incorporate a manual adjustability feature 112 to control force distribution (e.g., to selectively raise or otherwise adjust the press 103 when in the open position to control the pressure applied to the springs when in the closed position). For example, a number of interchangeable plates 113 could be selectively added/removed to adjust the thickness of the press 103 as necessary and/or desired across the length of the press 103 between the first 102 and the second ends 105, or, a tension screw 112 could be placed into the rotative coupling 101 side 102 of the press 103, to increase/decrease the pressure between the press 103 and the base 100. The press 103 can have a top portion 114 and a bottom portion 113 and the tension screw 112, (FIG. 5B) can apply more or less pressure to the bottom portion 113 of the press 103 so that strings 1, 2, and 3 (high E) have appropriate pressure. Then tension screw 112 can have a knurled portion 112 for grasping and turning the screw by hand, and/or can have a shape to engage a tool such as a Philips head screwdriver or other such tool.

The components discussed above may be formed of any appropriate material, including metal, plastic, ceramic, composite material, and/or a combination of materials.

Using the string locking device disclosed herein, a player may quickly and conveniently lock the guitar strings, manually and without the aid of locking hardware and/or external tools. In addition, once installed, the guitar may be selectively used with the device in the open or the closed positions, without the need to remove all or a portion of the device when the player does not wish to have the strings locked. Further, the sophisticated device accounts for the varying pressure/force requirements of each string thickness, ensuring effective locking of the thinnest to the thickest strings, while preventing severing of the thinnest strings.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. A string locking device for a musical instrument having a body, a neck extending proximally-to-distally from the body toward a number of tuning pegs, a fretboard disposed upon the neck, and a number of strings extending above the fretboard from the body to the tuning pegs, the musical instrument having a first side adjacent to a thinnest string of the set of the strings and a second side adjacent to a thickest string of the set of the strings, the string locking device comprising:

a base affixed to the neck adjacent to a distal end of the fretboard, the base extending from a first end positioned at the first side of the musical instrument to a second end positioned at the second side of the musical instrument, the base including a compression bed bordered by a set of proximal string channels and a set of distal string channels, wherein each of the strings extends through a select one of the proximal string channels, across the compression bed, through an aligned one of the distal string channels, and to an aligned one of the tuning pegs;

a press disposed above the base, the press extending from a first end positioned at the first side of the musical instrument to a second end positioned at the second side of the musical instrument;

a rotative coupling configured to pivotally connect the press to the base, the rotative coupling positioned toward the first end of the base; and a manual fastening mechanism configured to secure the press in a closed position relative to the base, the fastening mechanism positioned toward the second end of the base, wherein when the press is in the closed position, the number of the strings are secured between the compression bed and the press.

2. The string locking device of claim 1, wherein:

the press rotates between an open position in which the press is offset from the compression bed of the base and the closed position in which the press is secured against the compression bed of the base; and the musical instrument is functional when the press is in both the open position and the closed position.

3. The string locking device of claim 1, wherein the press has a gradually increasing thickness from the first end of the press to the second end of the press, and a tension screw is placed into the rotative coupling side of the press, to increase/decrease pressure between the press and the base.

4. The string locking device of claim 1, wherein the press has a gradually decreasing thickness from the first end of the press to the second end of the press.

5. The string locking device of claim 1, wherein the fastening mechanism comprises a finger extension and a mating slot, a swing catch, a snap lock, a drawbolt-and-buckle lock, a barrel-bolt lock, a belt-and-band lock, a wedge/taper lock, a quick-release pin, a rack-and-pinion lock, or a camp clamp.

6. The string locking device of claim 1, wherein the rotative coupling comprises a pin hinge.

7. The string locking device of claim 1, wherein the base, the press, the rotative coupling, and the fastening mechanism are formed of one or more of a metal, a plastic, a ceramic, and a composite material.

8. The string locking device of claim 1, wherein the musical instrument is a guitar and the string locking device is configured to replace a nut of the guitar.

9. A method for locking strings at a distal end of a fingerboard of a neck of a stringed instrument, the method comprising:

affixing a base to the neck adjacent to the distal end of the fingerboard, the base extending from a first end positioned at a first side of the instrument to a second end positioned at a second side of the instrument, the base including a compression bed bordered by a set of proximal string channels and a set of distal string channels, the string channels configured to receive the strings when the strings are extended along the neck to tuning pegs of the instrument;

pivotally coupling a press to a first end of the base, the press configured to pivot between an open position in which the strings are free to move relative to the press and the base, and a closed position in which the strings are secured between the press and the bed, the press extending between the first end of the base, positioned at the first side of the instrument, and a second end positioned at the second side of the instrument when the press is in the closed position; and configuring a fastening mechanism to operate between the base and the press to selectively secure the press in the closed position and to release the press to the open position.

* * * * *